US010280491B2

(12) United States Patent
Kim et al.

(10) Patent No.: US 10,280,491 B2
(45) Date of Patent: May 7, 2019

(54) LOW-ALLOY DUPLEX STAINLESS STEEL HAVING OUTSTANDING CORROSION RESISTANCE AND HOT WORKING PROPERTIES

(71) Applicant: POSCO, Pohang-si (KR)

(72) Inventors: Ji Soo Kim, Pohang-si (KR); Sang Kon Ahn, Pohang-si (KR); Bong Wn Kim, Pohang-si (KR); Kwang Tae Kim, Pohang-si (KR)

(73) Assignee: POSCO, Pohang-si (KR)

( * ) Notice: Subject to any disclaimer, the term of this patent is extended or adjusted under 35 U.S.C. 154(b) by 176 days.

(21) Appl. No.: 14/347,827

(22) PCT Filed: Sep. 28, 2012

(86) PCT No.: PCT/KR2012/007919

§ 371 (c)(1),
(2) Date: Mar. 27, 2014

(87) PCT Pub. No.: WO2013/048181

PCT Pub. Date: Apr. 4, 2013

(65) Prior Publication Data

US 2015/0267285 A1 Sep. 24, 2015

(30) Foreign Application Priority Data

Sep. 28, 2011 (KR) ..... 10-2011-0098320

(51) Int. Cl.
*C22C 38/42* (2006.01)
*C22C 38/44* (2006.01)
(Continued)

(52) U.S. Cl.
CPC ..... *C22C 38/58* (2013.01); *C21D 6/004* (2013.01); *C22C 38/001* (2013.01);
(Continued)

(58) Field of Classification Search
None
See application file for complete search history.

(56) References Cited

U.S. PATENT DOCUMENTS 4,486,231 A 12/1984 Fujiwara et al.
5,672,215 A 9/1997 Azuma et al.
(Continued)

FOREIGN PATENT DOCUMENTS

EP 0750053 A1 12/1996
EP 2258885 A1 3/2009
(Continued)

OTHER PUBLICATIONS

Machine-English translation of Japanese patent publication No. 2010-222695, Oikawa Yusuke et al. Mar. 25, 2009.*

*Primary Examiner* — Deborah Yee
(74) *Attorney, Agent, or Firm* — The Webb Law Firm

(57) ABSTRACT

Provided is a lean duplex stainless steel used in industrial facilities including fresh water, pulp and paper making, chemical and construction facilities. The lean duplex stainless steel comprises, in weight percentage (%), C: over 0 to 0.06 or less, Si: over 0 to 1.5% or less, Mn: over 0 to 2% or less, Cr: 19 to 23%, Ni: 1.8 to 3.5%, Mo: 0.5 to 1.0%, Cu: 0.3 to 1.0%, N: 0.16 to 0.30%, Al: 0.003 to 0.05%, B: 0.001 to 0.005% and Ca: 0.001 to 0.01%. In the stainless steel, the content of O of the stainless steel is 0.01% or less. The stainless steel comprises Fe and other unavoidable impurities as remnants.

6 Claims, 2 Drawing Sheets

(51) Int. Cl.

| | |
|---|---|
| ***C22C 38/54*** | (2006.01) |
| ***C22C 38/58*** | (2006.01) |
| ***C22C 38/40*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C21D 6/00*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/40* (2013.01); *C22C 38/42* (2013.01); *C22C 38/44* (2013.01); *C22C 38/54* (2013.01); *C21D 2211/001* (2013.01); *C21D 2211/005* (2013.01)

(56) References Cited

U.S. PATENT DOCUMENTS

| | | | |
|---|---|---|---|
| 6,096,441 | A | 8/2000 | Hauser et al. |
| 2003/0084971 | A1 | 5/2003 | Bergstrom et al. |
| 2003/0172999 | A1 | 9/2003 | Alfonsson et al. |
| 2004/0050463 | A1 | 3/2004 | Jung et al. |
| 2007/0163679 | A1 | 7/2007 | Fujisawa et al. |
| 2008/0112840 | A1 | 5/2008 | Kim et al. |
| 2009/0098007 | A1 | 4/2009 | Tsuge et al. |
| 2010/0000636 | A1 | 1/2010 | Bonnefois et al. |
| 2011/0097234 | A1 | 4/2011 | Oikawa et al. |

FOREIGN PATENT DOCUMENTS

| | | | |
|---|---|---|---|
| EP | 2050832 | A1 | 4/2009 |
| EP | 2199421 | A1 | 6/2010 |
| JP | 58-224155 | | 12/1983 |
| JP | 61-56267 | | 4/1986 |
| JP | 2006-183129 | A | 7/2006 |
| JP | 2007084837 | | 4/2007 |
| JP | 2010-084220 | | 4/2010 |
| JP | 2010-222695 | | 10/2010 |
| JP | 2010-229459 | | 10/2010 |
| KR | 10-2006-0074400 | A | 7/2006 |
| WO | 02/27056 | | 4/2002 |

* cited by examiner

LOW-ALLOY DUPLEX STAINLESS STEEL HAVING OUTSTANDING CORROSION RESISTANCE AND HOT WORKING PROPERTIES

CROSS-REFERENCE TO RELATED APPLICATIONS

This application is the United States national phase of International Application No. PCT/KR2012/007919 filed Sep. 28, 2012 and claims priority to Korean Patent Application No. 10-2011-0098320 filed Sep. 28, 2011, the disclosures of which are hereby incorporated in their entirety by reference.

TECHNICAL FIELD

An aspect of the present invention relates to a duplex stainless steel having a two-phase structure of austenite phase and ferrite phase. More particularly, an aspect of the present invention relates to a lean duplex or lean duplex stainless steel having a low content of high-priced alloy elements such as Ni and Mo in duplex stainless steel and improved corrosion resistance and hot workability.

BACKGROUND ART

In general, an austenite-based stainless steel known that its workability and corrosion resistance are excellent contains Cr and Ni as main raw materials, using iron (Fe) as a basis metal, and has been developed as various steels suitable for various kinds of uses by adding other elements such as Mo and Cu. The austenite-based stainless steel is a steel having excellent corrosion resistance and pitting corrosion resistance, and contains low carbon and Ni of 8% or more in weight percentage (wt %). However, in case of Ni, the range of fluctuation in price, caused by an increase of cost, is large, and therefore, price competitiveness is lowered. Accordingly, in order to solve such a problem, many studies have been conducted to develop a duplex stainless steel which contains a low content of Ni and has corrosion resistance equal to or greater than that of the austenite-based stainless steel.

The duplex stainless steel is a steel in which each volume fraction of austenite phase and ferrite phase is 35 to 65%. The duplex stainless steel has a low content of Ni while ensuring corrosion resistance equal to that of the conventional austenite-based stainless steel, and hence is economical. Further, it is easy to ensure high strength, and hence the duplex stainless steel has come into the spotlight as a steel material for industrial facilities including fresh water, pulp, paper making and chemical facilities, which require corrosion resistance. In addition, among duplex stainless steels, interest in a lean duplex stainless steel which further increases the advantage of a low alloy cost by excluding high-priced alloy elements such as Ni and Mo and adding low-priced alloy elements in place of the high-priced alloy elements has recently been increased. The low-alloy duplex stainless steel is usually referred to as a lean duplex stainless steel. Hereinafter, it will be explained that "lean low-alloy duplex" and "lean duplex" have the same meaning.

However, in case of the low-alloy duplex stainless steel, it is important that when the content of Ni and Mo is reduced, excellent corrosion resistance is ensured by controlling the balance of the austenite and ferrite phases due to the reduction in the content of Ni and Mo. In addition, it is important to improve hot workability capable of suppressing a defect or the like which may occur in manufacturing a plate of the lean duplex stainless steel. Generally, the lean duplex stainless steel has a low content of Cr, Mo and Ni, as compared with the existing duplex stainless steel, and therefore, the corrosion resistance of the lean duplex stainless is decreased. In addition, the stability of the ferrite and austenite phases is decreased due to the decrease in content of the alloy elements, and therefore, it is difficult to control the balance of each phase. Further, the phase fraction is rapidly changed depending on annealing temperature, and therefore, it is difficult to ensure an appropriate corrosion resistance level. Further, when welding is performed, the corrosion resistance of a heat affected zone (HAZ) portion may be lowered, and hence it is important to sufficiently ensure the corrosion resistance of a base metal.

In case of the duplex stainless steel, a defect occurs at surface and edge portions of the plate in hot deformation due to microstructure characteristics of the ferrite and austenite phases. The occurrence of such a defect becomes serious in the lean duplex stainless steel in which the content of the alloy elements is decreased. Ordinarily, it is known through several experiments that the temperature at which the hot workability of the duplex stainless steel is weakest is 900° C. The hot workability of the lean duplex stainless steel is weak in a low-temperature region of 800 to 900° C. When a material is hot-rolled, the temperature of the surface of the material is lowered to the temperature region due to contact of the material with a low-temperature roll when the roll is contacted with the surface of the roll, and therefore, a defect easily occurs in surface and edge portions of the material. Accordingly, it is necessary to improve hot workability in the temperature region.

For these reasons, the lean duplex stainless steel is limitedly used when the corrosion resistance of the lean duplex stainless steel is not problematic so much even though the alloy cost of the lean duplex stainless steel is considerably low. Therefore, there is a limitation in widely using the lean duplex stainless steel as a substitute of the existing austenite-based stainless steel. Further, since the lean duplex stainless steel is produced using a Steckel mill which easily secures the temperature of a hot-rolled plate even in production of the plate due to inferior hot workability, the lean duplex stainless steel is disadvantageous in terms of cost and productivity, as compared with that produced using a tandem mill.

Accordingly, an object of the present invention is to provide a lean or lean duplex stainless steel which can decrease the content of Cr, Mo and Ni, and ensure an appropriate corrosion resistance equal to or greater than that of 304 or 304L stainless steel that is an austenite-based stainless steel.

Another object of the present invention is to provide a lean or lean duplex stainless steel which can ensure excellent hot workability capable of suppressing a plate edge cracking defect and a surface cracking defect in the manufacturing of a plate of the lean or lean duplex stainless steel.

SUMMARY OF THE INVENTION

According to an aspect of the present invention, there is provided a lean duplex stainless steel comprising, in weight percentage (wt %), C: over 0 to 0.06 or less, Si: over 0 to 1.5% or less, Mn: over 0 to 2% or less, Cr: 19 to 23%, Ni: 1.8 to 3.5%, Mo: 0.5 to 1.0%, Cu: 0.3 to 1.0%, N: 0.16 to 0.30%, Al: 0.003 to 0.05%, B: 0.001 to 0.005% and Ca: 0.001 to 0.01%, wherein the content of O of the stainless steel is 0.01% or less, and wherein the stainless steel comprises Fe and other unavoidable impurities as remnants.

The content of the Mn may be 1.5 to 1.8% in weight %.

The stainless steel may control the content of the O, caused by Al deoxidation. The content of the Al contained in a molten steel may be 0.018 to 0.045% in weight %.

The content of the Ni may be 2 to 3% in weight %.

The content of the B may be 0.0025 to 0.0035% in weight %.

The content of the Ca may be 0.001 to 0.0085% in weight %. The content of the Ca may be 0.001 to 0.0035% in weight %.

The content of the B+Ca may be 0.0035 to 0.012% in weight %.

In the composition of the stainless steel, the $Cr_{eq}$ value represented by the following Formula (1) may be 22.5 to 23.5, and the $Ni_{eq}$ value represented by the following Formula (2) may be 9.5 to 11:

$$[Cr]+[Mo]+1.5[Si] \quad (1)$$

$$[Ni]+30([C]+[N])+0.5([Mn]+[Cu]) \quad (2).$$

The hot workability index calculated by the following Formula (3) may be 75 or more:

$$-195+10.2Cr_{eq}+1.19Ni_{eq}+822[Al]+1297(B+Ca) \quad (3).$$

The volume fraction of an austenite phase may range from 40 to 60%, and the volume fraction of a ferrite phase may range from 40 to 60%.

According to the present invention, it is possible to obtain a lean duplex stainless steel which can ensure an appropriate corrosion resistance equal to or greater than that of 304 or 304L austenitic stainless steel.

Further, the lean duplex stainless steel having excellent hot workability is manufactured, so that it is possible to suppress a plate edge cracking defect and a surface cracking defect in the manufacturing of a plate.

BEST MODE FOR CARRYING OUT THE INVENTION

Figure 1:
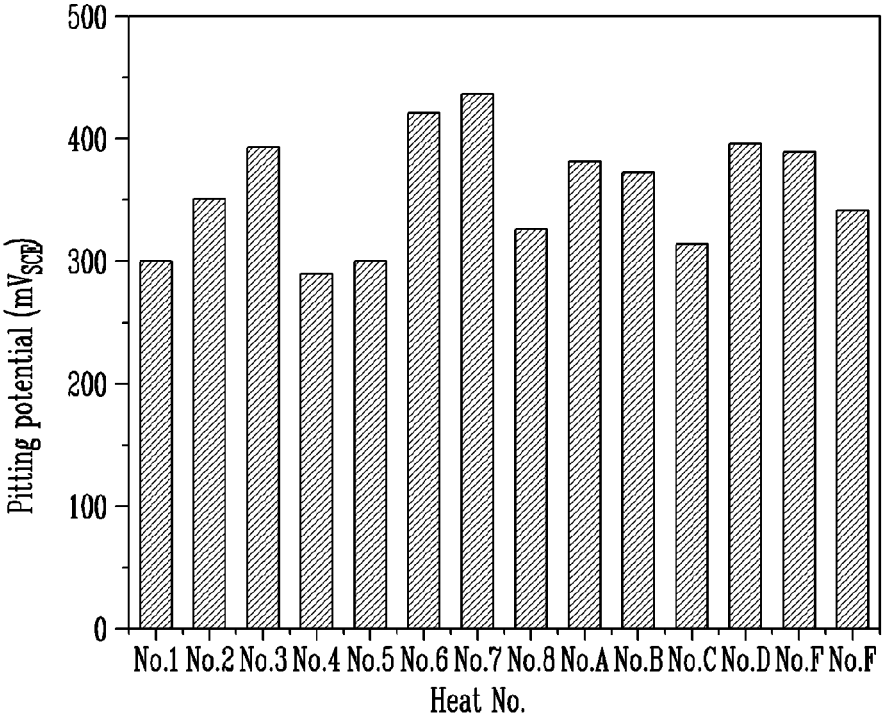
FIG. 1 is a graph showing a critical pitting temperature (CPT) in a lean duplex stainless steel according to an embodiment of the present invention.

Hereinafter, preferred embodiments of the present invention will be described in detail with reference to the accompanying drawings. However, the present invention is not limited to the embodiments but may be implemented into different forms. These embodiments are provided only for illustrative purposes and for full understanding of the scope of the present invention by those skilled in the art.

Hereinafter, properties which are generally known in the conventional lean duplex stainless steel will first be described for each item.

1. Phase Stability of Lean Duplex Stainless Steel

The conventional lean duplex stainless steel is disclosed in Japanese Patent Publication No. 61-56267, International Patent Publication No. WO 2002/27056, and the like. Among these publications, the lean duplex stainless steel disclosed in Japanese Patent Publication No. 61-56267 and International Patent Publication No. WO 2002/27056 is standardized as ASTM A240. The former corresponds to S32304 (representing elements 23Cr-4Ni-0.13N), and the latter corresponds to S32101 (representing elements 21Cr-1.5Ni-5Mn-0.22N). The lean duplex stainless steel metallurgically has a microstructure in which ferrite and austenite phases coexists, but the stability of each phase is decreased as alloy elements such as Cr, Mo and Ni which stabilize each phase are reduced. Meanwhile, In case of a stainless steel disclosed in U.S. Patent Publication No. US 2003/0172999 as another lean duplex stainless steel, the microstructure of the stainless steel exists in the region where austenite and ferrite phases coexist on the Schaeffler diagram. However, unlike a general duplex stainless steel, the microstructure approaches the area where austenite and martensite phases coexist. Therefore, the phase transformation in the microstructure is easily caused in deformation of the stainless steel, and it is necessary to maintain balance between the phases by adding an appropriate alloy element.

2. Economic Efficiency of Lean Duplex Stainless Steel

Meanwhile, S32205 duplex stainless steel is known as one of representative duplex stainless steels having a mixture structure of austenite and ferrite phases at normal temperature. This steel contains a large amount of Cr, Mo and N in order to ensure high corrosion resistance, and contains Ni of 5% or more in weight percentage (wt %) in order to secure phase fraction.

In addition, S81921 steel which has been disclosed in Korean Patent Publication No. 2006-0074400 and is standardized as ASTM A240 contains high-priced alloy elements, i.e., Ni of 2.5% and Mo of 2.4% as wt %. These duplex stainless steels provide a corrosion resistance superior to a required corrosion resistance in a specific application field, but contain a large amount of high-priced Ni and Mo, which is not appropriate in terms of economic efficiency.

3. Hot Workability of Lean Duplex Stainless Steel

The duplex stainless steel is a two-phase structure steel in which ferrite and austenite phases coexist. As the ferrite phase is mainly changed by a crystal structure difference between the ferrite and austenite in hot transformation of the duplex stainless steel at a high temperature, a crack caused by the hot transformation is easily generated on the interface between the ferrite and austenite phases. In addition, in case of the lean duplex stainless steel, the solid strengthening effect of the ferrite phase is weakened as Mo as a ferrite stabilization element is decreased. As the content of N in place of Ni that is an austenite stabilization element is increased, austenite is stabilized, and accordingly, the strength of the austenite phase is increased. Hence, as a result, the difference in strength between the ferrite and austenite phases becomes serious. Due to such a microstructure characteristic, a large quantity of edges and surface cracks occur in hot rolling of the lean duplex stainless steel, and accordingly, the lowering of productivity is caused.

In order to solve a problem of inferior hot workability of the duplex stainless steel, U.S Patent Publication No. US 2004/0050463 discloses a stainless steel which comprises, in mass percentage (mass %), C: 0.1% or less, Si: 0.05 to 2.2%, Mn: 2.1 to 7.8%, Cr: 20 to 29%, Ni: 3.0 to 9.5%, N: 0.08 to 0.5%, Mo: 5.0% or less, W: 1.2 to 8.0%, and Fe and other unavoidable impurities as remnants. In the invention, the content of the Cu that obstructs hot workability is limited, and the hot workability is improved by an increase in content of the Mn. However, the lowering of corrosion resistance may be caused by forming MnS in a microstructure of the stainless steel due to the increase in content of the Mn. Further, the degradation of welding property, caused by a high content of the Mn, is expected.

Japanese Patent Publication No. JP 2005-271307 discloses a duplex stainless steel which comprises, in mass %, C: 0.03% or less, Si: 0.1 to 2.0%, Mn: 0.1 to 2.0%, Cr: 20 to 30%, Ni: 1.0 to 11.0%, Cu: 0.05 to 3.0%, Nd: 0.005 to 0.5%, sol. Al: 0.001 to 0.1%, N: 0.1 to 0.5%, Mo: 0.5 to 6.0%, W: one or two kinds of 1.0 to 10.0%, and Fe and other unavoidable impurities as remnants. Among these impurities, P: 0.05% or less, and S: 0.03% or less. In the invention, it is reported that the P that becomes segregation at the ferrite/austenite gain boundary is stabilized using the Nd that is a rare-earth element, thereby improving hot workability. However, in a general duplex refining process, P with a content of 0.05% or less can be obtained without using the Nd that is a high-priced rare-earth element. The P is known as an element which causes brittleness at normal temperature even though the P becomes the segregation at the grain boundary. Therefore, it is expected that the P will not have great influence on the improvement of hot workability at a high temperature.

4. Corrosion Resistance of Lean Duplex Stainless Steel

In case of stainless steel (S32101) disclosed in International Patent Publication No. WO 2002/27056 as a lean duplex stainless steel, the content of Mn is 3 to 8% in mass %. As the content of Ni is decreased, the stability of an austenite phase is decreased. In this case, a large amount of nitrogen is added to compensate the stability of the austenite phase. However, when the solid solubility of nitrogen in the steel is low, the hot workability of a material may be lowered due to pores caused by the generation of nitrogen gas in production of the steel. In this case, if Mn is added, the solid solubility of the nitrogen increases, it is possible to ensure the stability of the austenite phase and to reduce the pores caused by the nitrogen gas. On the other hand, an MnS inclusion is formed by combining the Mn with S that is a grain boundary segregation element in the steel. The MnS extracted in the microstructure acts as a starting point of pitting, and hence the pitting resistance of a base metal is lowered.

The present inventors paid attention to the function of the Mn in the lean duplex stainless steel. In order to suppress the formation of the MnS as described above, the content of the S existing in the steel is necessarily controlled to be an extremely low content of 10 ppm or less, or the content of the Mn is necessarily lowered. The content of the Mn, as described above, increases the stability of the austenite phase and increases the solid solubility of the nitrogen. Hence, it is difficult to completely exclude the content of the Mn in the lean duplex stainless steel having a low content of the Ni. Since a process load is serious in a steel manufacturing process, the design of an alloy is required to suppress the formation of the MnS and to ensure the pitting resistance of the base metal by appropriately controlling the content of the Mn in order to control the content of the S to be an extremely low content.

In addition, it is important to form stable CaS by adding a small amount of Ca as well as the content of the Mn. Accordingly, it is possible to prevent the S from being segregated at the grain boundary and to suppress the formation of the MnS.

In order to extent of the usage of the base metal to be used in various environments, the general corrosion resistance of the base metal is important as well as the pitting resistance of the base metal. Thus, in order to ensure the general corrosion resistance, Cu having a content of 0.3 to 1.0% in mass % was added. The Cu was added by paying attention that the Cu was an alloy element having an operation of decreasing the corrosion speed of steel under an acidic atmosphere by stabilizing and strengthening a passivity membrane through addition of the Cu to a stainless alloy. However, when a large amount of Cu is added, the hot workability is obstructed, and hence an appropriate content of the Cu is necessarily is added.

The present inventors studied and researched correlation between alloy elements and hot workability with respect to the hot workability of a base metal of the lean duplex stainless steel. Particularly, among the alloy elements added to the stainless steel, Al is an element having a large chemical attraction with O, and acts as a strong deoxidizer to slightly reduce the content of the O. However, the O existing in the steel is segregated at the grain boundary between ferrite/austenite, ferrite/ferrite, austenite/austenite phases existing in a microstructure of the steel, so that the cleanness of the grain boundary is lowered. Therefore, the strength of the grain boundary is reduced due to the lowering of the cleanness of the grain boundary, and, as a result, the grain boundary becomes sensitive to cracks. Accordingly, cracks easily occur at the grain boundary in hot transformation of the base metal. As a result, the hot workability of the base metal is suppressed. Generally, S is known as a representative impurity which suppresses the hot workability of a base metal by being segregated at a grain boundary. Many studies and processes for reducing the content of the S have been developed and applied. In the present invention, in order to control the influence of the S, the formation of the stable CaS is promoted through the addition of the Ca, thereby preventing the S from being segregated at the grain boundary. Meanwhile, the content of the O existing in the steel is limited to 0.01% or less in mass % through the addition of a slight amount of the Al, thereby minimizing the influence of the O on the hot workability of the base metal. In addition, B is essentially added to improve the hot workability of the base metal. B improves the hot workability of the base metal by strengthening the grain boundary. However, when a large amount of the B is contained, this has bad influence on continuous casting, and therefore, it is important to add an appropriate content of the B.

The present inventors found a hot workability index in consideration of alloy elements as a method of deciding whether the hot workability of the lean duplex stainless steel is satisfactory. Through several experiments and documents, the present inventors founded that the reduction of area (RA) of the lean duplex stainless steel had the lowest value at 900° C. in estimation of the hot workability of the lean duplex stainless steel. In the present invention, when the RA value at 900° C. is 75 or more, the edge cracking phenomenon in hot rolling is remarkably reduced.

In the present invention, the hot workability indices are expressed as contents of Al, Ca and B essentially added to improve the hot workability in addition to C, Si, Mn, Cr, Ni, Mo, Cu and N which are representative alloy elements included in the lean duplex stainless steel. Particularly, the elements including Cr, Mo, Si and the like, which stabilize the ferrite phase, are represented by $Cr_{eq}$ values, and the elements including C, Mn, Ni, Cu, N and the like, which stabilize the austenite phase, are represented by $Ni_{eq}$ values. Through several times of experiments, the hot workability indices and factors are expressed as shown in the following formulae. The alloy elements represented in the following formulae have mass %.

$$Cr_{eq}=\%\ Cr+\%\ Mo+1.5\%\ Si \quad \text{Formula (1)}$$

$$Ni_{eq}=\%\ Ni+30(\%\ C+\%\ N)+0.5(\%\ Mn+\%\ Cu) \quad \text{Formula (2)}$$

$$RA=-195+10.2Cr_{eq}+1.19Ni_{eq}+822\%\ Al+1297(\%\ B+\%\ Ca) \quad \text{Formula (3)}$$

In the present invention, the lean duplex stainless steel contains, in mass %, C: over 0 to 0.06% or less, Si: over 0 to 1.5% or less, Mn: over 0 to 2% or less, Cr: 19-23%, Ni: 1.8 to 3.5%, Mo: 0.5 to 10%, N: 0.16 to 0.30%, Cu: 0.3 to 1.0%, and Fe and other unavoidable impurities as remnants.

According to the present invention, the lean duplex stainless steel having the alloy composition described above has low alloy cost, as compared with the austenite-based stainless steel. In addition, the lean duplex stainless steel of the present invention can ensure the pitting resistance of the base metal and also ensure the general corrosion resistance for extending the usage of the steel, so that the industrial applicability of the present invention is very high.

In the lean duplex stainless steel according to the present invention, Al: 0.003 to 0.05%, B: 0.001 to 0.005%, Ca: 0.001 to 0.01%, and the content of O is limited to 0.01% or less. When the lean duplex stainless steel of the present invention has the alloy composition described above, it is possible to ensure the hot workability that is a chronic problem in production of the low-allow duplex stainless steel. To this end, Al, B and Ca are added to decrease the content of S and O that are impurities segregated at a grain boundary, thereby improving the cleanness of the grain boundary. Accordingly, the grain boundary is strengthened, thereby improving the hot workability of the base metal.

In the present invention, the $Cr_{eq}$ and $Ni_{eq}$ values and RA value of the lean duplex stainless steel are controlled. The $Cr_{eq}$ value is controlled to be within a range of 22.5 to 23.5 in Formula (1), the $Ni_{eq}$ value is controlled to be within a range of 9.5 to 11 in Formula (2). In addition, the RA value obtained by Formula (3) is controlled to be 75 or more.

That is, in the lean duplex stainless steel of the present invention, the Cr and Ni equivalents can be indexed by the content of each alloy element added to the steel, and the reference capable of quantitatively deciding the hot workability of the steel is defined by comprehensively considering the influence that these alloy elements have on the hot workability index of the steel. In the present invention, it is possible to obtain the lean duplex stainless steel ensuring excellent hot workability, in which the hot workability index at 900° C. is 75 or more.

In the present invention, the volume fraction of the austenite phase is preferably 40 to 60%, and the volume fraction of the ferrite phase is preferably 40 to 60%.

Next, reasons for limiting the composition range of the lean duplex stainless steel of the present invention will be described in detail. The percentages of the following elements mean mass percentages.

C: The C is an element effective to increase material strength through solid strengthening. However, the C is easily combined with a carbide forming element such as Cr effective to corrosion resistance at the boundary between ferrite and austenite phases, so that the content of Cr near the grain boundary is decreased, thereby reducing the corrosion resistance. Hence, the content of the C is preferably limited to 0.06% or less in order to maximize the corrosion resistance.

Si: The Si is partially added for the purpose of deoxidation effect. However, since the Si also acts as a ferrite stabilization element, a portion of the Si is added. When the content of the Si added is excessive, the mechanical characteristic related to impact toughness is deteriorated, and therefore, the content of the Si is limited to 1.5% or less.

Mn: The Mn is generally contained with a content of about 1.5% in order to control the fluidity of molten steel, but the content of the Mn may be increased in place of high-priced Ni. In this case, the improvement of hot workability can be additionally obtained. If the content of the Mn is excessive, the Mn is combined with S in the steel, thereby forming MnS. As a result, the corrosion resistance is lowered, and the hot workability is also deteriorated. Hence, the content of the Mn is limited to 2% or less. However, in the present invention, the most preferable content of the Mn is limited to 0.15 to 0.18% that is less than 2%.

P: The P may be segregated at a grain boundary or phase boundary, thereby suppressing the corrosion resistance and ductility of the steel. Hence, the content of the P is preferably controlled as low as possible. Therefore, the content of the P is preferably limited to 0.03% or less in order to improve the efficiency of a steel manufacturing process.

S: The S is segregated at the grain boundary between the austenite and ferrite phases, thereby deteriorating the hot workability, or the corrosion resistance is lowered due to the formation of the MnS. Hence, the content of the S is preferably controlled as low as possible. Therefore, the content of the S is preferably limited to 0.002% or less.

Cr: The Cr as a ferrite stabilization element together with Mo performs a main function of securing the ferrite phase of the lean duplex stainless steel. In addition, the Cr is an essential element for ensuring corrosion resistance. If the content of the Cr is increased, the corrosion resistance is increased, but the content of high-priced Ni is proportionally increased to maintain phase fraction. Therefore, the content of the Cr is limited to 19 to 23% in order to ensure an appropriate level of the corrosion resistance while maintaining the phase fraction of the lean duplex stainless steel.

Ni: The Ni as an austenite stabilization element together with the Mn and N performs a main function of securing the phase fraction of the austenite phase of the lean duplex stainless steel. In order to reduce cost, the decrease in content of the Ni which is high priced can be offset by increasing the content of the Mn and N that are elements for forming the austenite phase. However, if the content of the Ni is excessively decreased, the content of the Mn and N is excessively increased. As a result, the corrosion resistance and the hot workability are reduced, or it is difficult to ensure the corrosion resistance due to a decrease in content of the Cr and Mo. Therefore, the content of the Ni is limited to 1.8 to 3.5%. Preferably, the content of the Ni is 2 to 3% in weight %.

Mo: The Mo is a ferrite stabilization element together with the Cr, and simultaneously, a strong element for improving corrosion resistance. However, the Mo is a very high-priced element. If the content of the Mo is excessive, the Mo easily forms a sigma phase in heat treatment, thereby lowering the corrosion resistance and impact toughness of the steel. In the present invention, the Mo performs an auxiliary function of the Cr for securing phase fraction and a function of ensuring an appropriated corrosion resistance. Therefore, the content of the Mo is limited to 0.5 to 1.0% in order to reduce manufacturing cost.

Cu: the Cu is known as an element for stabilizing the austenite phase together with the Ni, Mn and N. The Cu increases the corrosion resistance of the stainless steel under a sulfuric acid atmosphere. However, if the content of the Cu is 1% or more, the pitting resistance of the stainless steel is decreased. The Cu is known as an element that deteriorates the hot workability of the stainless steel. Therefore, the content of the Cu is preferably limited to 0.3 to 1.0%.

N: The N is one of elements which highly contribute to the stabilization of the austenite phase together with Ni. The increase in content of the N can additionally result in an increase in corrosion resistance and high strength. However, if the content of the N is extremely high, the hot workability is reduced, thereby decreasing a real yield ratio. On the contrary, if the content of the N is extremely low, the content of the Cr and Mo is necessarily decreased to secure phase fraction, and it is difficult to ensure welding portion strength and phase stability. Therefore, the content of the N is preferably limited to 0.16 to 0.30%.

Meanwhile, the lean duplex stainless steel of the present invention additionally contains Al, B and Ca.

Al: The Al is an important element for deoxidation of the stainless steel, and the Al with a content of 0.003% or more is necessarily added to reduce oxygen in the steel. On the other hand, the Al is an element having a relatively high chemical attraction with the N. If the content of the Al is excessively added, MN is formed, thereby lowering the ductility and corrosion resistance of the base metal. Therefore, the content of the Al is limited to 0.003 to 0.05%.

Meanwhile, in the present invention, oxygen O is a harmful element constituting an oxide that is a representative of non-metal inclusion. If the O is excessively contained, segregation is made at a grain boundary, and therefore, the cleanness of the grain boundary is reduced, thereby suppressing the hot workability of the steel. In addition, the excessively contained O produces an oxide in a coarse cluster form, which results in surface cracks. Therefore, the content of the O is limited to a maximum of 0.01%. In the present invention, the content of the Al as a deoxidizer is necessarily controlled in order to improve the hot workability by limiting the content of the O to 0.01% or less. To this end, the content of the Al injected in the molten steel is preferably 0.018 to 0.045% in weight %. The Al is injected as a deoxidizer to limit the content of the O, but rises as a floating matter and then removed. Therefore, it is likely that the content of the Al will be detected as 0.018% or less in a final product of the steel. The preferable content of the Al will be described later with reference to FIG. 2.

B: The B is known as an element which is segregated at a grain boundary to strengthen the grain boundary. The content of the B is preferably 0.001 to 0.005% in order to improve the hot workability of the stainless steel. More preferably, the B has a content of 0.0025 to 0.0035% in weight %.

Ca: The Ca is an element which forms a stable CaS compound through the combination of the Ca with the S that is a grain boundary segregation element, so that the grain boundary of the S is suppressed, thereby improving the hot workability of the steel. However, when the Ca is excessively contained, the weldability may be obstructed, and therefore, the content of the Ca is preferably limited to 0.001 to 0.01%. More preferably, the Ca has a content of 0.001 to 0.0035% in weight %.

Figure 3:
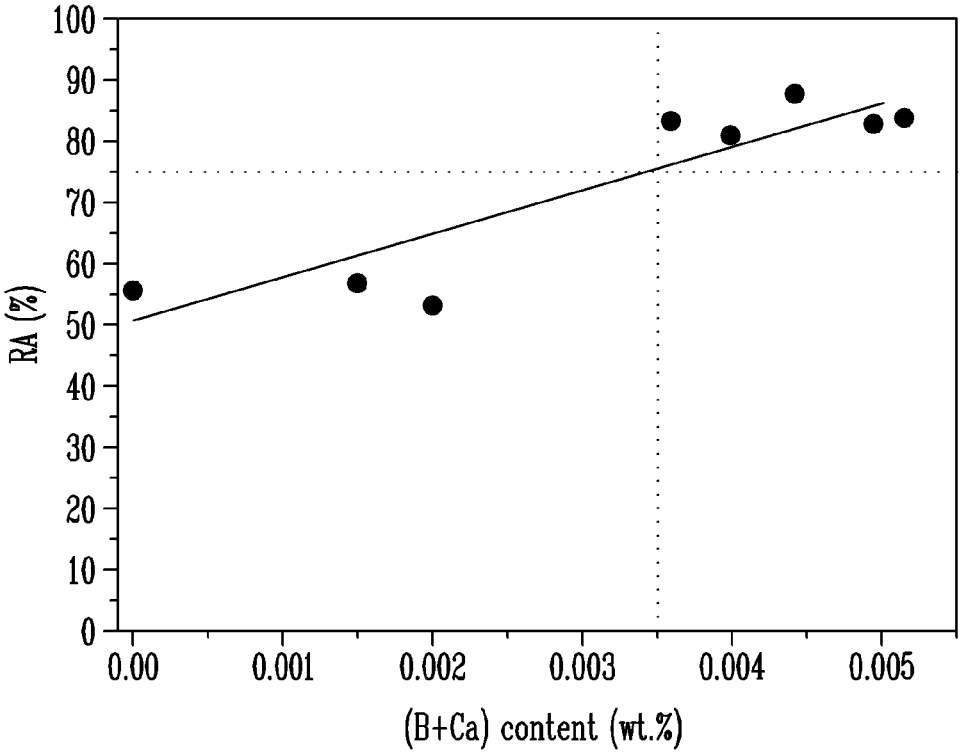
FIG. 3 is a graph showing influence of B and Ca on the hot workability index of the lean duplex stainless steel according to the embodiment of the present invention.

Meanwhile, in the present invention, the B and Ca are simultaneously added so that the content of B+Ca is from at least 0.0035% or more to 0.012%, thereby improving the hot workability. FIG. 3 shows a change in hot workability index depending on the content of the B+Ca. As shown in this figure, it can be seen that the RA (%) that represents a hot workability index when the content of the B+Ca is 0.0035% or more has 75 or more.

In the lean duplex stainless steel of the present invention, it is important to control Cr equivalent ($Cr_{eq}$) and Ni equivalent ($Ni_{eq}$) values. First, the Cr equivalent in the following Formula (1) is known as an index obtained by converting the influence of Cr, Mo, Si and Nb that are ferrite forming elements in a general stainless steel into the influence of Cr. In the present invention, the Nb is not contained in the alloy elements, and hence the term Nb is excluded from the Cr equivalent formula. The degree where the alloy elements of the Cr, Mo and Si contribute to the stability of the ferrite phase can be indexed by the following formula (1). The present inventors found that the Cr equivalent value became no less than 22.5 and no more than 23.5 in order to obtain the balance between the ferrite and austenite phases in the lean duplex stainless steel obtained by decreasing the content of the Ni. Accordingly, the range of the Cr equivalent values was limited.

$$Cr_{eq}=\%\ Cr+\%\ Mo+1.5\%\ Si \qquad \text{Formula (1)}$$

Next, in the present invention, reasons for limiting the Ni equivalent ($Ni_{eq}$) value will be described. Like Formula (1) described above, the Ni equivalent in the following Formula (2) is an index obtained by converting the influence of C, Mn, Ni, Cu and N that are austenite forming elements in the stainless steel into the influence of Ni. In the low-ally duplex stainless steel of the present invention, the content of the Ni is limited to 1.8 to 3.5%, and accordingly, the content of each alloy element is controlled to obtain the balance between the ferrite and austenite phases. As a result, the present inventors found that the Ni equivalent value in the lean duplex stainless steel necessarily became no less than 9.5 and no more than 11. Accordingly, the range of the Ni equivalent value was limited.

$$Ni_{eq}=\%\ Ni+30(\%\ C+\%\ N)+0.5(\%\ Mn+\%\ Cu) \qquad \text{Formula (2)}$$

In the present invention, when a lean duplex stainless steel is beyond the range of Cr and Ni equivalent values, the RA of the lean duplex stainless steel is low as 75% or less.

Next, the RA as a hot workability index in the present invention will be described. The hot workability of the duplex stainless steel is estimated through the rate where the sectional area of a material is reduced when the material is extended in one direction by being heat at a specific temperature. The reduction rate of the sectional area can be expressed as a hot workability index called as RA (%). The RA tends to proportionally increase as temperature increases. However, the RA value of a general duplex stainless steel shows the minimum value at a temperature near 900° C. Hence, the present inventors found through repetitive experiments that the RA value was increased, thereby improving the hot workability of the entire steel. In the present invention, the minimum value of the RA value at 900° C. was used as a range of the hot workability index. As described above, the hot workability of the duplex stainless steel is highly influenced by the kind and content of an alloy element included in the steel. Particularly, the hot workability of the duplex stainless steel is highly influenced by elements such as O and S which are segregated at the gain boundary, and hence it is necessary to decrease the content of the grain boundary segregation elements. In order to decrease the content of the O, the deoxidation is to be efficiently performed in the process of manufacturing the duplex stainless steel. Si deoxidation was mainly performed as the existing deoxidation method, but there was a limitation in decreasing the content of the O to 50 ppm or less. Thus, when the deoxidation is performed using Al with a higher chemical attraction with O than Si, the content of O can be decreased up to a target level. In addition, a double slagging technique is used to decrease the content of S to 10 ppm or less in the steel manufacturing process. In this case, the process is complicated, and manufacturing cost is increased. In order to solve such a problem, Ca is added to suppress the segregation at the gain boundary by allowing the S in the steel to exist as a stable compound form. In order to improve the hot workability by strengthening the grain boundary, a small amount of B is added, thereby improving the hot workability of the steel. Through embodiments in which the hot workability is improved by adding the Al, B and Ca, the RA value at 900° C. can obtain a great value of 75% or more. The present inventors found through experiments that edge and surface cracking defects are remarkably reduced in a hot rolling process. As a result, the hot workability index can be expressed as a relationship of the workability index with the content of alloy elements included in the low-ally duplex stainless steel. The present inventors found that the minimum value of the hot workability index necessarily became 75 or more, and accordingly, limited the range of the hot workability index. In the present invention, the percentages of elements in Formula (3) mean mass percentages.

Next, the volume fraction between the austenite and ferrite phases in the present invention will be described. In the embodiments of the present invention, the volume fraction of the austenite phase is limited to a range of 40 to 60%, and the volume fraction of the ferrite phase is limited to a range of 40 to 60%. When the volume fraction of the austenite phase is less than 40%, a ductility failure occurs. When the volume fraction of the austenite phase exceeds 60%, the hot workability is deteriorated. In any case, the corrosion resistance is lowered. Thus, when solution heat-treatment is performed near 1050° C. that is an ordinary condition in the duplex stainless steel, the content ratio of Ni, Cu, Mn, C, N and the like which are elements for increasing the volume fraction of the austenite phase and Cr, Mo, Si and the like are elements for increasing the volume fraction of the ferrite phase is controlled in order to secure the volume fraction of the austenite phase and the volume fraction of the ferrite phase. Specifically, the volume fraction of the austenite phase and the volume fraction of the ferrite phase are controlled in the range of the Cr and Ni equivalent values shown in Formulae (1) and (2) described above.

Embodiments

Hereinafter, embodiments of the present invention will be described.

First, samples of lean duplex stainless steels with respect to element composition ranges according to the present invention were prepared, and the phase fraction, corrosion resistance and hot workability index of each sample were measured. These measured values are shown in the following tables. In Table 1, embodiments of the present invention and comparative examples are listed together, and remnants except the elements listed in Table 1 are Fe and other unavoidable impurities. Particularly, the steel No. 1 in Table 1 has components of STS304 steel, and the corrosion resistance of steels of the present invention was controlled to be equal to or greater than that of the steel No. 1.

TABLE 1

| | | Component Content (Mass %) | | | | | | | | | | | | |
|---|---|---|---|---|---|---|---|---|---|---|---|---|---|---|
| Classification | Remark | C | Si | Mn | Cr | Ni | Mo | Cu | B | N | Al | O | Ca | B + Ca |
| 1 | Comparative | 0.037 | 0.57 | 1.15 | 18.3 | 8.44 | 0.22 | 0.20 | 0.0023 | 0.03 | 0.001 | 0.0110 | — | 0.0023 |
| 2 | Examples | 0.030 | 0.57 | 5.0 | 21.2 | 1.45 | 0.31 | 0.29 | 0.0027 | 0.21 | 0.011 | 0.0075 | 0 | 0.0027 |
| 3 | | 0.021 | 0.45 | 2.5 | 21.5 | 2.50 | 0.59 | 0.29 | 0.0018 | 0.20 | 0.024 | 0.0051 | 0.0011 | 0.0029 |
| 4 | | 0.025 | 0.51 | 2.5 | 21.5 | 1.51 | 0.50 | 0.50 | 0.0026 | 0.19 | 0.015 | 0.0090 | 0 | 0.0026 |
| 5 | | 0.025 | 0.51 | 2.5 | 21.5 | 1.50 | 0.50 | 1.00 | 0.0027 | 0.19 | 0.012 | 0.0095 | 0 | 0.0027 |
| 6 | | 0.059 | 0.62 | 2.2 | 20.8 | 2.32 | 0.51 | 0.75 | 0.002 | 0.23 | 0.000 | 0.0150 | 0 | 0.002 |
| 7 | | 0.024 | 0.51 | 2.8 | 21.4 | 1.94 | 0.55 | 0.68 | 0.0015 | 0.31 | 0.006 | 0.0100 | 0 | 0.0015 |
| 8 | | 0.017 | 1.35 | 1.5 | 19.7 | 1.82 | 0.84 | 0.86 | 0.0035 | 0.25 | 0.012 | 0.0120 | 0.0010 | 0.0045 |
| A | Embodiments | 0.020 | 0.48 | 1.8 | 21.4 | 2.48 | 0.60 | 0.30 | 0.0035 | 0.19 | 0.035 | 0.0018 | 0.0015 | 0.005 |
| B | | 0.019 | 0.46 | 1.8 | 21.3 | 2.51 | 0.61 | 0.30 | 0.0025 | 0.20 | 0.042 | 0.0019 | 0.0013 | 0.0038 |
| C | | 0.028 | 1.00 | 1.8 | 21.2 | 2.53 | 0.62 | 0.51 | 0.0025 | 0.16 | 0.019 | 0.0074 | 0.001 | 0.0035 |
| D | | 0.021 | 0.52 | 1.8 | 21.2 | 2.38 | 0.58 | 0.32 | 0.0028 | 0.20 | 0.031 | 0.0021 | 0.0020 | 0.0048 |
| E | | 0.024 | 0.55 | 1.8 | 21.3 | 2.48 | 0.61 | 0.30 | 0.0027 | 0.21 | 0.029 | 0.0032 | 0.0032 | 0.0059 |
| F | | 0.028 | 0.56 | 1.8 | 21.6 | 2.38 | 0.59 | 0.92 | 0.0025 | 0.22 | 0.026 | 0.0041 | 0.0028 | 0.0053 |
| G | | 0.018 | 0.54 | 1.5 | 21.1 | 2.56 | 0.58 | 1.1 | 0.0028 | 0.21 | 0.029 | 0.0023 | 0.0019 | 0.0047 |
| H | | 0.021 | 0.48 | 1.6 | 21.4 | 2.32 | 0.052 | 0.9 | 0.031 | 0.2 | 0.023 | 0.004 | 0.0085 | 0.0116 |

TABLE 2

| Steel No. | Remark | PREN | $Cr_{eq}$ | $Ni_{eq}$ | Pitting potential mV | Phase Fraction % | RA % |
|---|---|---|---|---|---|---|---|
| 1 | Comparative | 19.5 | 19.4 | 11.1 | 300 | 0 | 87.6 |
| 2 | | 25.6 | 22.4 | 11.3 | 350 | 48.12 | 59.1 |
| 3 | Examples | 26.6 | 22.8 | 10.5 | 392 | 51.68 | 73.2 |
| 4 | | 26.2 | 22.8 | 9.4 | 290 | 52.28 | 64.3 |
| 5 | | 26.2 | 22.8 | 9.7 | 300 | 53.78 | 62.3 |
| 6 | | 26.2 | 22.3 | 12.4 | 421 | 46.31 | 49.6 |
| 7 | | 28.2 | 22.7 | 13.7 | 436 | 41.58 | 60.1 |
| 8 | | 26.4 | 22.5 | 11.0 | 326 | 51.94 | 63.7 |
| A | Embodiments | 26.4 | 22.7 | 9.8 | 380 | 53.02 | 83.7 |
| B | | 26.5 | 22.6 | 10.1 | 372 | 50.34 | 87.0 |
| C | | 25.8 | 23.4 | 9.5 | 314 | 55.42 | 75.2 |
| D | | 26.3 | 22.6 | 10.1 | 395 | 52.47 | 79.1 |
| E | | 26.7 | 22.8 | 10.6 | 389 | 51.81 | 81.4 |
| F | | 27.1 | 23.0 | 11 | 342 | 50.56 | 77.3 |
| G | | 26.4 | 22.6 | 10.2 | 351 | 51.22 | 78.9 |
| H | | 26.3 | 22.6 | 10.2 | 349 | 52.12 | 77.8 |

Meanwhile, in Table 2, the electrochemical corrosion resistance was evaluated with respect to the comparative examples and the embodiments of the present invention. The results obtained by evaluating phase fractions of the ferrite phase in a microstructure and hot workability indices are shown in Table 2. In addition, the $Cr_{eq}$, $Ni_{eq}$ and RA shown in Table 2 means the following Formulae (1), (2) and (3), respectively.

$$Cr_{eq}=\%\ Cr+\%\ Mo+1.5\%\ Si \quad \text{Formula (1)}$$

$$Ni_{eq}=\%\ Ni+30(\%\ C+\%\ N)+0.5(\%\ Mn+\%\ Cu) \quad \text{Formula (2)}$$

$$RA=-195+10.2Cr_{eq}+1.19Ni_{eq}+822\%\ Al+1297(\%\ B+\%\ Ca) \quad \text{Formula (3)}$$

First, the lean duplex stainless steel containing the components described above was melted in a smelting furnace of 50 kg in a laboratory, thereby casting the melted steel as a steel ingot having a thickness of 150 mm, a width of 150 mm and a length of 250 mm. The steel ingot was heated at a temperature of 1250° C. for one or two hours, and then rolled under the condition of a finishing temperature of 850 to 950° C., thereby obtaining a steel plate having a thickness of 12 mm and a length of about 3000 mm. In addition, spray cooling was performed on the steel plate up to 200° C. or less in a state in which the temperature of the steel plate just after the rolling was 800° C. or more. Final solution heat-treatment was performed under the condition of water cooling after cracking at 1050° C. for 30 minutes.

Subsequently, a corrosion resistance evaluation test was performed using the steel plate with a thickness of 12 mm, manufactured as described above, as a base metal. The corrosion resistance evaluation test was performed using an electrochemical method called as a potentiostatic anodic polarization test. Under conditions of the polarization test, the surface of a sample was sequentially polished with 60, 120, 320 and 600 sandpapers. Then, only the surface with an area of 1 $cm^2$ was exposed, and the other surface was surrounded with a masking tape, so that a test solution is not contacted with the other surface of the sample. Subsequently, the sample was immersed in a 3.5% NaCl solution maintained at 30, and electric potential was applied to the sample, thereby measuring electric potential where pitting occurs.

For the phase fraction of the ferrite phase, the section parallel to the rolling direction of the steel plate was buried in resin and then polished. Subsequently, electrochemical etching was performed in a KOH aqueous solution, and image analysis was performed by observation using an optical microscope, thereby measuring the phase fraction of the ferrite phase.

For the hot workability index, a sample was machined so that the direction parallel to the rolling direction in the steel plate with a thickness of 12 mm, and thus the standard of the sample has the shape of a circular rod having a length of 110 mm and a diameter of 10 mm. The sample machined in such a manner approached a target temperature by raising the temperature of the sample up to 1250° C. at a rising temperature speed of average 20° C./s, and then maintained for 3 minutes. The sample was cooled down to a test temperature at a speed of average 10° C./s, and then maintained at the test temperature for 30 seconds. Subsequently, the sample was extended in one direction at a stroke speed of 30 mm/s. The test temperature was set to an interval of 100° C. from 800° C. to 1200° C., and the RA value was evaluated using a value obtained by dividing an initial section into the section of the sample after the test. As described above, the value used as an RA value in the present invention was set to the RA value at 900° C.

Referring to Table 2 in which values for the evaluation results, the phase fractions of the ferrite phase in the steels according the embodiments of the present invention all have satisfactory values.

Meanwhile, FIG. 1 is a graph showing a critical pitting temperature (CPT) in a lean duplex stainless steel according to an embodiment of the present invention.

As shown in FIG. 1, the pitting potential of each of the steels Nos. 4, 5 and C is lower than or has a slight difference from that of the steel No. 1. This is because the content of the Mn is high (Nos. 4 and 5) or the content of the N is low (No. C). As a result, the corrosion resistance is inferior. Although the content of the Mn is high, the steel in which the content of the N is 0.2% in mass % shows a high pitting potential, as compared with the STS304. In addition, it can be seen that when the steels have the same content of the N (Nos. 2, 3, 6, B, D and E), the steel is advantageous in corrosion resistance as the content of the Mn decreases.

Figure 2:
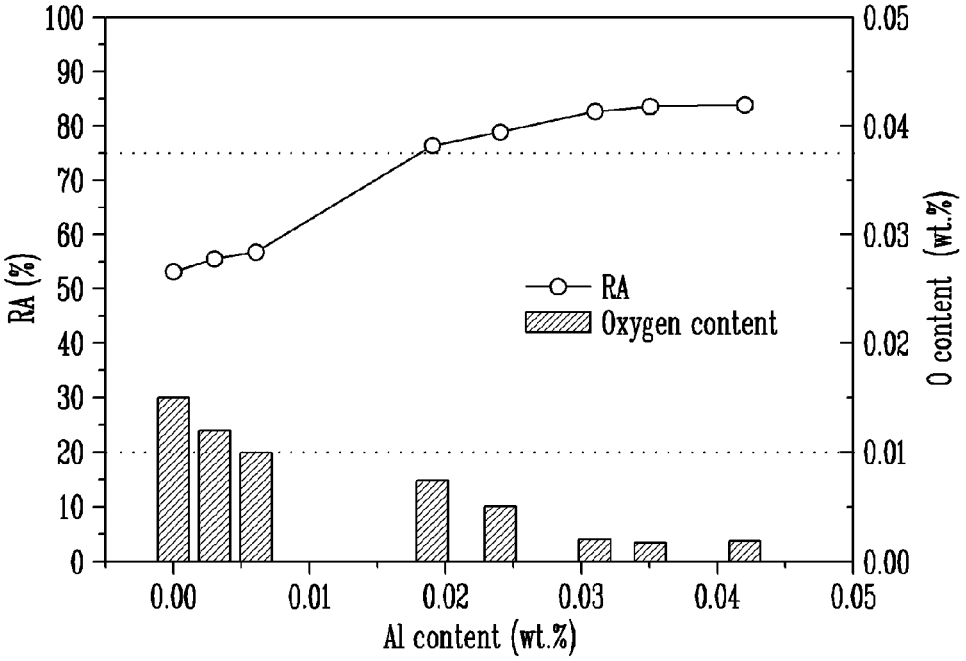
FIG. 2 is a graph showing influence of Al and O on the hot workability index of the lean duplex stainless steel according to the embodiment of the present invention.

FIG. 2 is a graph showing influence of Al and O on the hot workability index of the lean duplex stainless steel according to the embodiment of the present invention. FIG. 3 is a graph showing influence of B and Ca on the hot workability index of the lean duplex stainless steel according to the embodiment of the present invention.

For the hot workability, when the content of Mn and O is high, the RA value is low. As the result obtained by rolling the steel plate, the edge crack in the steel plate became 20 mm or more (Nos. 2, 8, D and E). In addition, the RA value was remarkably increased by adding the B, Ca and Al. When the RA value at 900° C. was 75% or more, any edge crack did not occur, which was satisfactory (Nos. A, B, C, D and F). Particularly, as the results obtained by analyzing oxygen according to the embodiments, the content of the oxygen was 50 ppm or less. However, although the content of the oxygen became 100 ppm or less, the edge shape of the steel plate was satisfactory (Nos. 6, 7 and C).

According to the embodiments, it can be seen that the hot workability of the steel is influenced by main alloy elements including the Cr, Ni, Mn, Mo, N and the like but highly influenced by a small amount of added elements including the Al, B, Ca and the like. Particularly, as shown in FIG. 2, it can be seen that the RA value is highly influenced by the Al. Since the Al lowers the content of the oxygen in the steel, it can be seen that the RA value is increased depending on the addition of the Al. As shown in FIG. 3, the small amount of added elements including the B, Ca and the like stabilize the S in the steel, thereby improving the hot stability of the steel. In the embodiments of Table 1, the Ca represents the embodiments of the present invention, which is injected within a range of 0.001 to 0.01%.

According to the present invention, it is possible to provide a lean duplex stainless steel having low alloy cost and excellent corrosion resistance, as compared with the conventional austenite-based stainless steel. Accordingly, it is possible to prevent the occurrence of an edge crack caused by the deterioration of hot workability of the lean duplex stainless steel. As a result, it is possible to reduce the production load of the lean duplex stainless steel. In addition, the lean duplex stainless steel is used in place of the high-priced austenite-based stainless steel, thereby promoting the improvement of economic efficiency. Thus, the industrial applicability of the present invention is very high.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

The invention claimed is:

1. A lean duplex stainless steel having excellent in corrosion resistance and hot workability comprising, in weight percentage (wt %), C: over 0 to 0.06 or less, Si: over 0 to 1.5% or less, Mn: 1.5 to 1.8%, Cr: 19 to 23%, Ni: 1.8 to 3.5%, Mo: 0.5 to 1.0%, Cu: 0.3 to 1.0%, N: 0.16 to 0.30%, Al: 0.003 to 0.05%, B: 0.001 to 0.005, Ca: 0.001 to 0.01%, and B+Ca: 0.0035 to 0.0053%, wherein the content of O of the stainless steel is 0.01% maximum, wherein the stainless steel comprises Fe and other unavoidable impurities as remnants, wherein, in the composition of the stainless steel, the $Cr_{eq}$ value represented by the following Formula (1) is 22.5 to 23.5, and the $Ni_{eq}$ value represented by the following Formula (2) is 9.5 to 11:

$$[Cr]+[Mo]+1.5[Si] \quad (1)$$

$$[Ni]+30([C]+[N])+0.5([Mn]+[Cu]) \quad (2),$$

wherein the volume fraction of an austenite phase ranges from 40 to 60%, and the volume fraction of a ferrite phase ranges from 40 to 60%, wherein the hot workability index calculated by the following Formula (3) is 75 or more:

$$-195+10.2Cr_{eq}+1.19Ni_{eq}+822[Al]+1297(B+Ca) \quad (3),$$

wherein the hot workability index is the minimum value of the reduction rate of the sectional area of the stainless steel at 900° C., and wherein the reduction rate of the sectional area, RA, is 75% or more.

2. The lean duplex stainless steel of claim 1, wherein the stainless steel controls the content of the O, caused by Al deoxidation, and wherein the content of the Al contained in a molten steel is 0.018 to 0.045% in weight %.

3. The lean duplex stainless steel of claim 1, wherein the content of the Ni is 2 to 3% in weight %.

4. The lean duplex stainless steel of claim 1, wherein the content of the B is 0.0025 to 0.0035% in weight %.

5. The lean duplex stainless steel of claim 1, wherein the content of the Ca is 0.001 to 0.0085% in weight %.

6. The lean duplex stainless steel of claim 5, wherein the content of the Ca is 0.001 to 0.0035% in weight %.

* * * * *